US008250818B2

(12) United States Patent
Tremblay et al.

(10) Patent No.: US 8,250,818 B2
(45) Date of Patent: Aug. 28, 2012

(54) SELF-CENTERING ENERGY DISSIPATIVE BRACE APPARATUS WITH TENSIONING ELEMENTS

(76) Inventors: Robert Tremblay, Montréal (CA); Constantin Christopoulos, Toronto (CA)

( * ) Notice: Subject to any disclaimer, the term of this patent is extended or adjusted under 35 U.S.C. 154(b) by 1103 days.

(21) Appl. No.: 10/591,381

(22) PCT Filed: Mar. 3, 2005

(86) PCT No.: PCT/CA2005/000339

§ 371 (c)(1), (2), (4) Date: May 9, 2007

(87) PCT Pub. No.: WO2005/085543

PCT Pub. Date: Sep. 15, 2005

(65) Prior Publication Data

US 2008/0016794 A1 Jan. 24, 2008

Related U.S. Application Data

(60) Provisional application No. 60/549,172, filed on Mar. 3, 2004.

(51) Int. Cl.
*E04H 9/00* (2006.01)
*E04B 1/98* (2006.01)

(52) U.S. Cl. ..... 52/167.3; 52/1

(58) Field of Classification Search ..... 52/167.1–167.9, 52/1, 223.1, 223.6, 223.14, 235; 188/371, 188/377, 266, 2 D; 267/201, 219
See application file for complete search history.

(56) References Cited

U.S. PATENT DOCUMENTS

| | | | | | |
|---|---|---|---|---|---|
| 4,065,218 | A | | 12/1977 | Biggane | 403/71 |
| 4,371,143 | A | * | 2/1983 | Ishida et al. | 248/638 |
| 4,409,765 | A | | 10/1983 | Pall | 52/167.1 |
| 4,499,694 | A | | 2/1985 | Buckle et al. | 52/167.7 |
| 4,605,106 | A | * | 8/1986 | Fyfe et al. | 188/374 |
| 4,662,133 | A | * | 5/1987 | Kondo | 52/167.6 |
| 4,795,003 | A | * | 1/1989 | Colgate | 188/71.4 |
| 5,224,689 | A | * | 7/1993 | Georgiev | 267/225 |
| 5,347,771 | A | | 9/1994 | Kobori et al. | 52/167.1 |
| 5,456,047 | A | | 10/1995 | Dorka et al. | 52/167.4 |
| 5,471,810 | A | | 12/1995 | Sugisawa et al. | 52/731.7 |
| 5,502,932 | A | | 4/1996 | Lu | 52/167.9 |
| 5,560,162 | A | | 10/1996 | Kemeny | 52/167.3 |
| 5,662,046 | A | * | 9/1997 | Wright et al. | 105/167 |
| 5,727,663 | A | | 3/1998 | Taylor | 188/378 |
| 5,819,484 | A | | 10/1998 | Kar | 52/167.3 |
| 5,842,312 | A | | 12/1998 | Krumme et al. | 52/167.1 |
| 5,845,438 | A | | 12/1998 | Haskell | 52/167.1 |
| 5,870,863 | A | | 2/1999 | Taylor | 52/167.3 |
| 5,946,866 | A | | 9/1999 | Weglewski et al. | 52/167.1 |
| 6,170,202 | B1 | | 1/2001 | Davoodi et al. | 52/167.1 |

(Continued)

FOREIGN PATENT DOCUMENTS

CA 1150474 7/1983

(Continued)

*Primary Examiner* — Branon Painter
*Assistant Examiner* — Elizabeth A Plummer

(57) ABSTRACT

The present invention generally relates to a self-centering energy dissipative brace apparatus. A bracing system is often needed to stabilize, strengthen or stiffen structures such as buildings which are subjected to severe or extreme conditions. The brace apparatus may be installed in a structure to dissipate input energy and minimize residual deformations related to exceptional loading imposed on the structure by winds, earthquakes, impacts or explosions. The apparatus integrates self-centering properties and energy, dissipative capacities which help minimize structural damage.

32 Claims, 12 Drawing Sheets

U.S. PATENT DOCUMENTS

| | | | | |
|---|---|---|---|---|
| 6,223,483 | B1 | 5/2001 | Tsukagoshi | 52/167.1 |
| 6,230,450 | B1 * | 5/2001 | Kuroda et al. | 52/167.8 |
| 6,256,943 | B1 | 7/2001 | Mander et al. | 52/167.1 |
| 6,438,905 | B2 | 8/2002 | Constantinou | 52/167.3 |
| 6,598,365 | B2 * | 7/2003 | Abraham et al. | 52/403.1 |
| 7,065,927 | B2 * | 6/2006 | Powell et al. | 52/167.3 |
| 7,182,187 | B2 * | 2/2007 | Mochimaru et al. | 188/297 |
| 7,188,452 | B2 * | 3/2007 | Sridhara | 52/167.3 |
| 2001/0000840 | A1 | 5/2001 | Takeuchi et al. | 52/167.1 |
| 2001/0007297 | A1 * | 7/2001 | Gramb | 188/298 |
| 2003/0205008 | A1 | 11/2003 | Sridhara | 52/167.3 |
| 2003/0222188 | A1 | 12/2003 | Smelser et al. | 248/188.91 |
| 2004/0107654 | A1 | 6/2004 | Powell et al. | 52/167.3 |
| 2009/0260304 | A1 * | 10/2009 | Mochimaru et al. | 52/167.1 |
| 2012/0000147 | A1 * | 1/2012 | Chou et al. | 52/167.1 |

FOREIGN PATENT DOCUMENTS

| | | | |
|---|---|---|---|
| CA | 2181949 | | 1/1997 |
| JP | 58131442 | A * | 8/1983 |
| JP | 09-279695 | | 10/1997 |
| JP | 2003-193699 | | 7/2003 |
| WO | WO 2004/111485 | | 12/2004 |

* cited by examiner

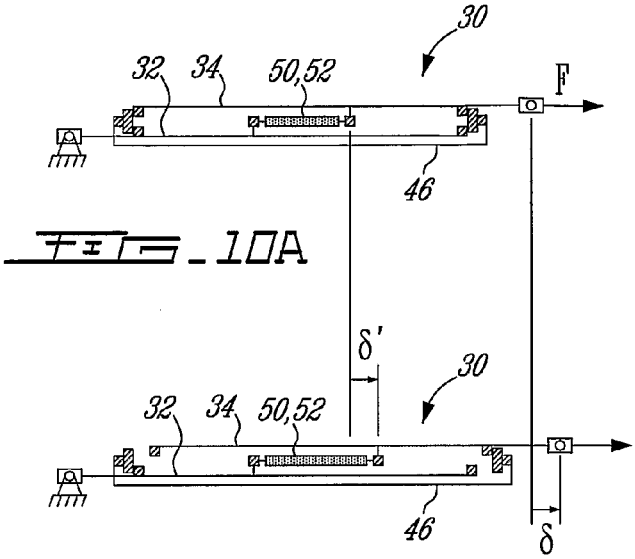
FIG. 10A
FIG. 10C
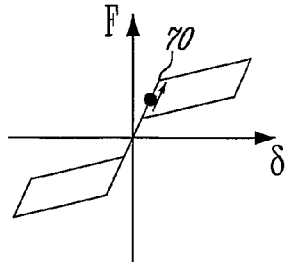
FIG. 10B
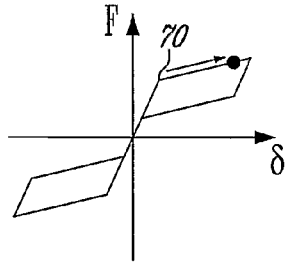
FIG. 10D
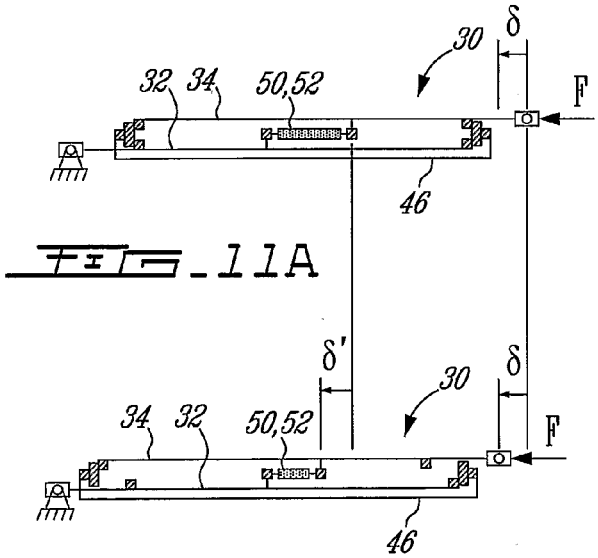
FIG. 11A
FIG. 11C
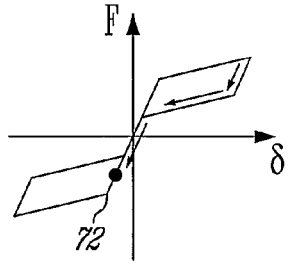
FIG. 11B
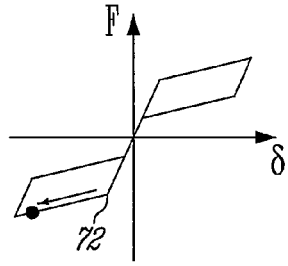
FIG. 11D

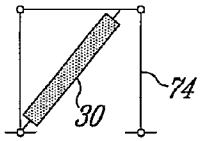
FIG. 14A
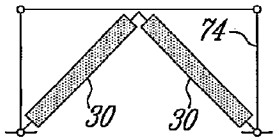
FIG. 14B
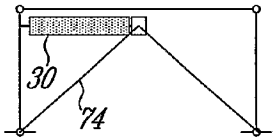
FIG. 14C
FIG. 14D
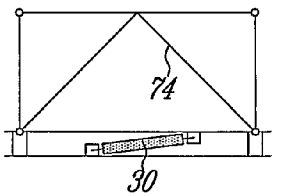
FIG. 14E
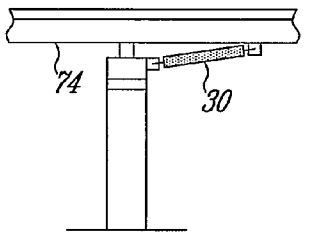
FIG. 14F
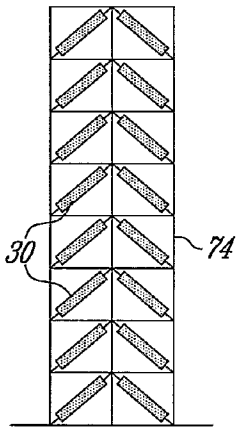
FIG. 14G
FIG. 14H
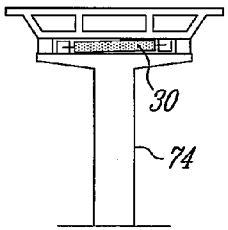
FIG. 14I
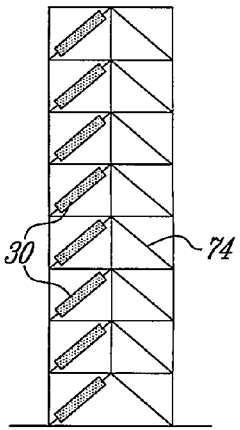
FIG. 14J

SELF-CENTERING ENERGY DISSIPATIVE BRACE APPARATUS WITH TENSIONING ELEMENTS

This application is a national phase application under 35 U.S.C. §371 of International Application No. PCT/CA2005/000339 filed 3 Mar. 2005, which claims priority to U.S. Provisional Patent Application Ser. No. 60/549,172, filed 3 Mar. 2004, the contents of which are incorporated herein by reference in their entirety.

FIELD OF THE INVENTION

The present invention generally relates to an energy dissipative brace apparatus with self-centering properties. More specifically, the present invention is concerned with a brace apparatus for installation in structures which may be subjected to extreme loading conditions.

BACKGROUND OF THE INVENTION

Although the design of structures under normal loading conditions aims at meeting serviceability and ultimate strength requirements by providing strength, stiffness and stability, it has been recognized recently that to effectively and safely resist extreme loading conditions such as earthquakes and blast loads, a fundamentally different approach must be used. It is economically unfeasible as well as being potentially unsafe to design structures for linear elastic response under such loading conditions, especially if, as a result of this design philosophy, no ductility capacity is provided in the system. This implies that the nonlinear behavior of yielding systems, which limits the seismic forces induced in structures, is a highly desirable feature.

For yielding systems, the energy dissipated per cycle through hysteretic yielding (inelastic deformations) is generally associated with structural damage. Such yielding systems are expected to sustain residual deformations which can greatly impair the structure and increase repair costs. This raises important questions which usually remain unanswered following extreme loading conditions: does a structure that has undergone a certain level of inelastic deformation still provide the same level of protection as before? Must all yielded elements be replaced? Must the state of the material at every location where yielding has taken place be assessed?

There also exists a strong belief, mainly from the public, that a structure designed according to the latest seismic codes, for example, would require little or no structural repair and would result in minimal disruption time following an earthquake. Current research efforts in earthquake engineering still embrace this philosophy of achieving stable hysteretic response of predetermined elements of the structure. Structural damage and residual deformations are therefore expected under design level earthquakes.

For example, traditional steel braced frames are designed primarily to assure life safety under a major earthquake. They are expected to sustain significant damage after an earthquake due to repeated cycles of brace tension yielding and brace compression buckling. Furthermore, as a direct consequence of the damage induced in these elements, the final state of the entire building is likely to be out of plumb. Similar response is also expected from the other conventional steel, reinforced concrete, masonry and timber structural systems (moment-resisting frames, walls, etc.). Poor structural performance also results in damage to operational and functional components of buildings, such as architectural components, building services or building contents. Both structural and non structural damage can impact on the safety and rescue of building occupants and can lead to interruption of building operations.

This reality has important consequences as to the costs of repair and the costs induced by disruption time following an important earthquake. Note that a structure that is found to be structurally sound after an earthquake may be condemned if the costs of straightening are elevated or if it appears unsafe to occupants. Increasingly, owners of structures in seismic prone areas that are faced with the expected state of their structure following a major earthquake often opt to directly implement higher performance systems. Furthermore, insurance companies are also increasingly basing their premiums on expected damage costs, and with this additional incentive, the number of owners that will adopt high performance systems for new or existing structures is likely to increase.

The current state-of-the-art for specialized dampers that are used to improve seismic performance mainly consists of either hysteretic (yielding), friction, viscously damped, viscoelastic systems or shape memory alloys. The hysteretic (yielding) systems consist of elements that are designed to undergo repeated inelastic deformations and that exhibit variable hysteretic responses.

A first family of such systems is referred to as yielding systems such as the buckling restrained braces or yielding steel plates. Yielding systems have been successfully implemented in numerous projects in Asia and North America. A second family of such systems is referred to as friction systems, of which one of the most popular is the Pall system. This system has been implemented in a very large number of structures in the past 15 years.

Note that none of these two families of systems exhibits self-centering properties, which can negatively impact on the overall performance of structures when subjected to earthquakes and other severe or extreme loads and may result in permanent deformations.

Viscous systems are specialized devices that exhibit a velocity dependent force and increase the damping of the structure thus reducing the response under seismic loading. Viscoelastic dampers also exhibit a velocity dependant force to increase damping while providing an additional elastic restoring force in parallel. Structures equipped with viscous and visco-elastic dampers require the main structural system to provide sufficient elastic stiffness and strength to resist the applied loads. These devices do not assure self-centering properties if the main structural elements undergo inelastic deformations.

A shape memory alloy is generally a metal that regains by itself its original geometrical configuration after being deformed or heated to a specific temperature. Shape memory alloys generally provide highly specialized production capability, but are generally expensive materials.

To date, self-centering behavior has mainly been achieved by specialized dampers comprised of complex inter-connected spring elements that require sophisticated fabrication processes and shape memory alloy materials that are prohibitive in most common structural projects because of elevated costs.

In U.S. Pat. No. 5,819,484 entitled "Building structure with friction based supplementary damping in its bracing system for dissipating seismic energy" (issued on Oct. 13, 1998), Kar teaches about a brace apparatus that provides re-centering capabilities through a friction spring energy dissipating unit, but which converts tension and compression applied to the apparatus into compression exerted on the stack between the two ends of the apparatus which are mountable to two portions of a building.

In U.S. Pat. No. 5,842,312 entitled "Hysteritic damping apparati and methods" (issued on Dec. 1st, 1998), Krumme et al. teach about damping apparatus using one or more tension elements fabricated from shape-memory alloy to provide energy dissipation. However, the apparatus of Krumme et al. which has two relatively moving bracing members linked together by the tension elements provides that some tension elements are involved during a force loading, but the self-centering behavior of the damping apparatus results from specific nonlinear material properties and do not involve mechanical interaction between elastic components.

The previous discussion leads to suggest that an optimal extreme load resistant system should:

i) incorporate the nonlinear characteristics of yielding structures to limit the forces imposed on the system by the severe or extreme loading, and dissipate input energy to control deformation;

ii) reduce the cost of repairs of the structure by encompassing re-centering properties allowing it to return to its original position after the extreme loading;

iii) further reduce the cost of repair by minimizing the occurrences of damages to the main structural elements.

Optimal resistance to severe or extreme loading increases the performance level of structures in the event of a major earthquake, hurricane or the like which sometimes occur in highly populated urban areas. Structures equipped with these high performance elements significantly offer better responses to such extreme loading with minimal damage, reduced repair costs and disruption time.

Furthermore, these systems may be very attractive to local, provincial and federal government facilities as well as to owners and managers of critical facilities that must remain functional during and immediately after major or catastrophic events.

OBJECTS OF THE INVENTION

An object of the present invention is therefore to provide an apparatus which encompasses the same architectural features as current technology and the same response characteristics under service loads, but offers a highly enhanced response under severe cyclic loading which minimizes structural damage and efficiently provides self-centering characteristics.

A further object of the present invention is to provide an apparatus which efficiently develops the aforementioned hysteresis and self centering capacities by combining simple and structural elements and readily available materials such as, for example, structural steel and high-strength tensioning elements.

SUMMARY OF THE INVENTION

More specifically, in accordance with the present invention, there is provided an apparatus designed in the form of a bracing system that achieves a hysteretic behavior and self-centering properties by combining specialized components that can be built using readily available construction materials. In addition the apparatus may be provided with energy dissipating systems such as, but not limited to, friction surfaces, yielding sacrificial members, visco-elastic materials, viscous fluid dampers or shape memory alloys to provide the desired level of energy dissipation.

There is therefore provided a brace apparatus to be mounted between two portions of a structure subjected to a loading force to limit movements due to the loading force, the brace apparatus including a fixed portion having a first end to be mounted to a portion of the structure, the first end defining a first abutting surface and a second end defining a second abutting surface, the brace apparatus further including a movable portion having a first end to be mounted to a portion of the structure, the first end defining a first abutting surface and a second end defining a second abutting surface, the brace apparatus further including a tensionable assembly mounting the movable portion to the fixed portion so that a) the first movable portion abutting surface is in proximity of the second fixed portion abutting surface, and b) the first fixed portion abutting surface is in proximity of the second movable portion abutting surface, the tensionable assembly including a first abutting element in the proximity of the first end of the fixed portion and a second abutting element in the proximity of the first end of the movable portion; the first and second abutting elements being interconnected by an adjustable tensioning element; wherein, i) when a loading force moves the movable portion away from the fixed portion, the first abutting element abuts the first fixed portion abutting surface and the second abutting element abuts the first movable element abutting surface to thereby limit the movement of the movable portion away from the fixed portion and ii) when a loading force moves the movable portion towards the fixed portion, the first abutting element abuts the second movable portion abutting surface and the second abutting element abuts the second fixed element abutting surface to thereby limit the movement of the movable portion towards the fixed portion.

There is therefore provided a brace apparatus mountable between two portions of a structure subjected to a loading force, the brace apparatus including a first bracing member having a first end mountable to one of the two portions and a second end, each having an abutting surface, a second bracing member having a third end and a fourth end mountable to another one of the two portions and each having an abutting surface, the first and second bracing members being movably operatable between a rest position and a transitional position such that i) the first end is in proximity of the third end so as to define a first proximity end pair and the second end is in proximity of the fourth end so as to define a second proximity end pair, ii) the first end is opposed to the fourth end so as to define a first opposed end pair and the second end is opposed to the third end so as to define a second opposed end pair, the brace apparatus further including a tensionable assembly including abutting elements in the proximity of the first and second proximity end pairs, the abutting elements being interconnected by a tensioning element; whereby the first and second bracing members are movable apart when the loading force applied to the first opposed end pairs i) tensions the apparatus such that respective abutting surfaces of the first opposed end pair abuts on respective abutting elements, ii) compresses the apparatus such that respective abutting surfaces of the second opposed end pair abuts on respective abutting elements; the tensioning element being tensionable under the loading force such as to alternatively move the first and second bracing members from the rest position to the transitional position.

Other objects, advantages and features of the present invention will become more apparent upon reading of the following non-restrictive description of preferred illustrative embodiments thereof, given by way of example only with reference to the accompanying drawings.

BRIEF DESCRIPTION OF THE DRAWINGS

In the appended drawings:

FIG. 10*a* is a schematic view showing the brace apparatus of FIG. 1, equipped with a friction or yielding energy dissipative mechanism, when under tension and before the tension force is large enough to overcome the initial pre-tensioning of the tensioning elements;

FIG. 10*b* is a diagram of the hysteretic response of the system as shown in FIG. 10*a;*

FIG. 10*c* is a schematic view showing the brace apparatus of FIG. 1 equipped with a friction or yielding energy dissipative mechanism, when under tension and when the tension force is larger than the force required to overcome the initial pre-tensioning of the tensioning elements;

FIG. 10*d* is a diagram of the hysteretic response of the system as shown in FIG. 10*c;*

FIG. 11*a* is a schematic view showing the brace apparatus of FIG. 1 equipped with a friction or yielding energy dissipative mechanism, when under compression, and before the applied load is large enough to overcome the initial pre-tensioning of the tensioning elements;

FIG. 11*b* is a diagram of the hysteretic response of the system as shown in FIG. 11*a;*

FIG. 11*c* is a schematic view showing the deformation of the different components of the brace apparatus of FIG. 1 equipped with a friction or yielding energy dissipative mechanism when under compression and when the applied load is large enough to overcome the initial pre-tensioning of the tensioning elements;

FIG. 11*d* is a diagram of the hysteretic response of the system as shown in FIG. 11*c;*

FIG. 14*a* is a schematic side elevation view of a first structure incorporating the brace apparatus of FIG. 1;

FIG. 14*b* is a schematic side elevation view of a second structure incorporating the brace apparatus of FIG. 1;

FIG. 14*c* is a schematic side elevation view of a third structure incorporating the brace apparatus of FIG. 1;

FIG. 14*d* is a schematic side elevation view of a fourth structure incorporating the brace apparatus of FIG. 1;

FIG. 14*e* is a schematic side elevation view of a fifth structure incorporating the brace apparatus of FIG. 1;

FIG. 14*f* is a schematic side elevation view of a sixth structure incorporating the brace apparatus of FIG. 1;

FIG. 14*g* is a schematic side elevation view of a seventh structure incorporating the brace apparatus of FIG. 1;

FIG. 14*h* is a schematic side elevation view of an eighth structure incorporating the brace apparatus of FIG. 1;

FIG. 14*i* is a schematic side elevation view of a ninth structure incorporating the brace apparatus of FIG. 1;

FIG. 14*j* is a schematic side elevation view of a tenth structure incorporating the brace apparatus of FIG. 1;

DETAILED DESCRIPTION

The present invention relates to a brace apparatus provided for the dissipation of input energy applied to structure systems, such as for example beams, columns, braces, walls, wall partitions, subjected to severe, extreme and/or repetitive loading conditions. The brace apparatus is mountable to portions of the structure to restrain or oppose to the relative motion between the two portions. In doing so, the brace apparatus generally maintains minimal residual deformations, dissipates energy and includes self-centering capacities once the input energy changes or ceases to be applied to the structure. Typically, input energies are related to exceptional loadings caused by winds, earthquakes, impacts or explosions which are sometimes imposed on structures or architectural systems.

Figure 1:
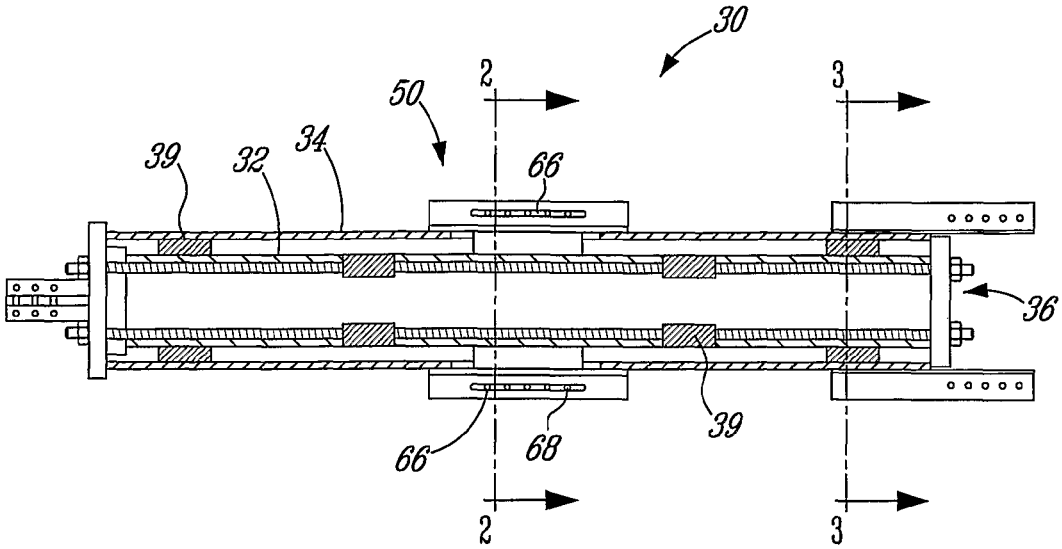
FIG. 1 is a side elevation view showing the interior of a brace apparatus according to a first illustrative embodiment of the present invention.

As shown in the illustrative embodiment of FIG. 1, the apparatus 30 generally includes a first bracing member 32, a second bracing member 34, a tensionable assembly 36, energy dissipative systems 38 and guiding elements 39. The second bracing member 34 may be viewed as a fixed member and the first bracing member 32 may be viewed as a movable member of the apparatus 30. Of course, one skilled in the art will understand that the movement between the members 32 and 34 is relative.

Figure 2:
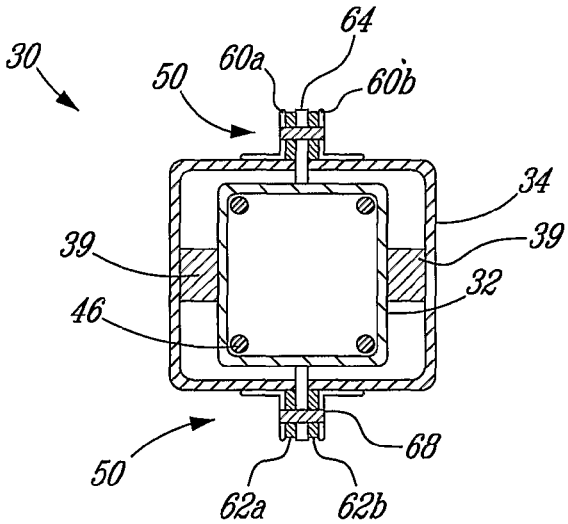
FIG. 2 is a section view taken along line 2 in FIG. 1.
Figure 3:
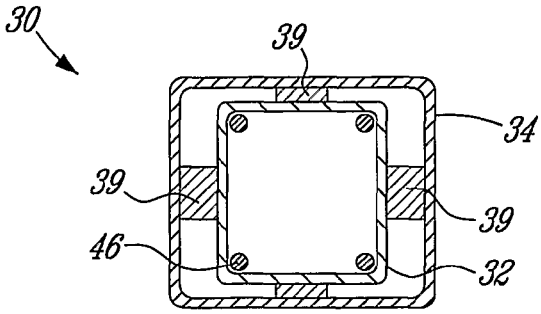
FIG. 3 is a section view taken along line 3 in FIG. 1.
Figure 4A:
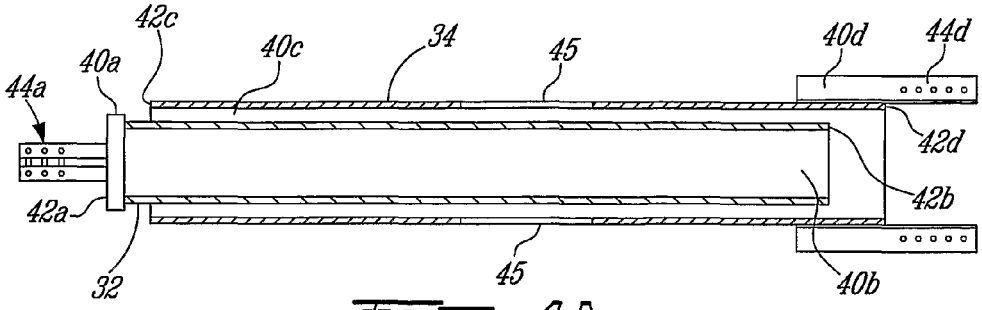
FIG. 4*a* is an exploded partial side elevation view showing bracing members of the brace apparatus of FIG. 1.

The bracing members 32 and 34, shown in FIGS. 1 to 3 and in more details in FIG. 4*a*, include ends 40*a*, 40*b*, 40*c*, 40*d* provided with respective abutting surfaces 42*a*, 42*b*, 42*c*, 42*d* which are configured and sized as to abut with the tensionable assembly 36. The bracing members 32 and 34 further include apertures 45 providing the space requirement for the installment of the energy dissipative systems 38 and for inspection of the apparatus 30 after operation, as will be further described hereinbelow.

For clarity purposes, the various ends 40*a*, 40*b*, 40*c*, 40*d* of the bracing members 32 and 34 will also be referred to as "end pairs" of the apparatus 30 in the following description. More specifically, the end 40*a* which is in proximity of the end 40*c* define a first proximity end pair and the end 40*b* which is in proximity of the end 40*d* define a second proximity end pair. Similarly, the end 40*a* which is opposed to the end 40*d* define a first opposed end pair and the end 40*b* which is opposed to the end 40*c* define a second opposed end pair.

In the illustrative embodiment of FIGS. 1 to 4*d*, ends 40*a*, 40*d* (the first opposed end pair) are further provided with end connections 44*a*, 44*d* adapted for mounting the apparatus 30 on the external structure (not shown) subjected to input energy. The end connections 44*a*, 44*d* are plates or any other structural element fixedly attached (welds, bolted or joined assemblies) to the bracing members 32 and 34. The end connections 44*a*, 44*d* are configured and sized so as to receive a loading force and as to transmit it to the apparatus 30. Optionally, the end connections 44*a*, 44*d* are further designed to yield at a certain loading force level to protect the integrity of the apparatus 30.

The bracing members 32 and 34, are generally parallel, longitudinally extending and independently movable one with respect to the other when subjected to a certain level of loading force. In the illustrative embodiment, the first bracing member 32 is a tubular member located inside of and generally concentric to the second bracing member 34.

Figure 4B:
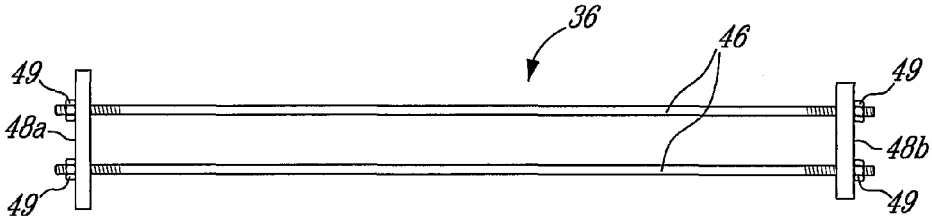
FIG. 4*b* is an exploded partial side elevation view showing a tensionable assembly of the brace apparatus of FIG. 1.

As illustrated in FIGS. 1 to 3 and in more details in FIG. 4*b*, the tensionable assembly 36 includes four adjustable tensioning elements 46 (only two shown in FIG. 4*b*), and two abutting elements 48*a*, 48*b* interconnected by the tensioning elements 46. The tensioning elements 46 are generally pre-tensionable tendons, cables or rods which are mounted to the abutting elements 48*a*, 48*b* through various types of fastener assemblies, such as for example nuts 49, clamping or attachment devices capable of providing tension adjustability to the tensioning elements 46.

The tensioning elements 46 are generally symmetrically positioned with respect to the abutting elements 48*a*, 48*b* in order to provide for better load distribution within the tensionable assembly 36. The number of tensioning elements 46, their modulus of elasticity, their ultimate elongation capacity, their total area and their length are selected to achieve the desired strength, the post-elastic stiffness, the deformation capacity, and the self-centering capacity of the apparatus 30.

The tensioning elements 46 are capable of deforming under a loading force applied to the apparatus 30 such as to allow a targeted elongation of the apparatus 30 resulting from relative movement between the two bracing members 32 and 34, as will be further described hereinbelow. This deformation first generally occurs without yielding and with minimal loss of the pre-tensioning force in the tensioning elements 46.

The level of pre-tension in the tensioning elements 46 generally ranges from no pre-tension at all to some fraction, typically between 20% and 60% of the maximum allowed deformation of the tensioning element 46. The level of pre-tensioning determines the force level at which the relative movement starts between the bracing members 32 and 34, determines the initiation of energy dissipation in the energy dissipative mechanisms 38 and determines the change in the stiffness of the tensioning elements 46 ranging from the initial elastic stiffness to the post-elastic stiffness. The level of pre-tension also provides the re-centering capability of the apparatus 30, as will be further explained hereinbelow. If the level of pre-tension is not sufficient to overcome the force required to activate the energy dissipation mechanisms 38, the apparatus generally does not display a full re-centering capacity, but the tensioning elements 46 generally provide additional post-elastic stiffness to the apparatus 30.

The abutting elements 48*a*, 48*b* are plates or any other suitable structural elements that are positioned in the proximity of the first and second proximity end pairs 40*a*, 40*c* and 40*b*, 40*d*. The abutting elements 48*a*, 48*b* are configured and sized so as to cooperate with the abutting surfaces 42*a*, 42*b*, 42*c*, 42*d* of the ends 40*a*, 40*b*, 40*c*, 40*d* when the bracing members 32 and 34 are moving with respect to one another under a loading force, as will be further explained hereinbelow.

In the illustrative embodiment of FIGS. 1 and 4*b*, the abutting element 48*a* includes a passage (not shown) extending therethrough and into which the end connection 44*a* is slidably received. The other abutting element 48*b* is slidably received within the end connection 44*d*.

Turning back to FIGS. 1 and 3, the guiding elements 39 are shown in the form of plates, blocks, or other suitable structural elements which are provided between the bracing members 32 and 34 to allow, guide or impose the relative movement of the bracing members 32 and 34, while still helping to maintain their relative alignment. Guiding elements 39 may also be used to connect or mount the tensionable assembly 36 along the length of the bracing members 32 and 34, to enhance the buckling capacity of members 32 and 34. The guiding elements 39 may further include absorbing materials such as for example rubber, Teflon® or elastomeric materials which are used to mitigate impact between the bracing members 32 and 34.

Energy dissipative systems 38, which are schematically illustrated in FIGS. 1 to 5 and 10*a* to 13*d*, include friction 50, yielding 52, viscous 54 and/or visco-elastic 56 mechanisms or other components such as for example shape-memory alloys 57 that are mobilized or involved to dissipate energy when relative movement develops between the bracing members 32 and 34. These mechanisms may be used individually or in combination such that the properties of the energy dissipative system 38 can be tuned to achieve any desired response under specific types of loading force. The energy dissipative system 38 is generally chosen to sustain minimal damage under severe loading and/or to be easily replaceable. Further, the energy dissipative system 38 is generally designed to allow quick inspection and replacement within the apparatus 30, with minimized disruption time following any extreme loading situation.

The friction mechanisms 50 illustrated in FIGS. 1 and 2 each includes two support members 60*a*, 60*b*, two friction interfaces 62*a*, 62*b* and an extending member 64. In the illustrative embodiment, the support members 60*a*, 60*b* are fixedly mounted on the bracing member 34, and each includes a slot 66. The extending member 64 is fixedly mounted on the bracing member 32 and extends toward the support members 60*a*, 60*b* such that fasteners 68 fixedly mounted through the extending member 64 engage the slots 66 to hold the friction mechanism 50 in a clamping arrangement.

The friction interfaces 62*a*, 62*b* are located in the clamping arrangement between the support members 60*a*, 60*b* and the extending member 64 are so configured and sized as to provide friction between the two bracing members 32 and 34. Depending on where friction sliding occurs in the friction mechanism 50, the friction interfaces 62*a* and 62*b* may or may not include slots that correspond to the slots 66 of the support members 60*a*, 60*b*.

The clamping arrangement provides that a normal force generates friction between the friction interfaces 62*a*, 62*b* when there is relative motion between the bracing members 32 and 34. In the illustrative embodiment of FIGS. 1 and 2, the slot 66 and fastener 68 are mounted in a sliding arrangement to first allow a relative movement between the bracing members 32 and 34. The sliding arrangement provides a restrained movement capacity of the extending member 64 attached to the fastener 68, which is guided by the slot 66 along the direction of movement of the bracing members 32 and 34.

Optionally, the friction interfaces 62*a*, 62*b* may be removed from the friction mechanism 50 if support members 60*a*, 60*b*, and extending element 64 exhibit the required frictional characteristics. In this case, the friction is achieved by directly clamping together the support members 60*a*, 60*b* and the extending member 64. Further optionally, the slot 66 may be positioned directly on the extending member 64.

The friction mechanism 50 generally displays stable hysteretic characteristics under dynamic loading, with minimal uncertainty on initial and long-term friction properties. Specialized, non-metallic friction interfaces (not shown), or treated metallic surfaces (not shown) may also be used to provide specific hysteretic characteristics to the friction dissipative mechanism.

Figure 5:
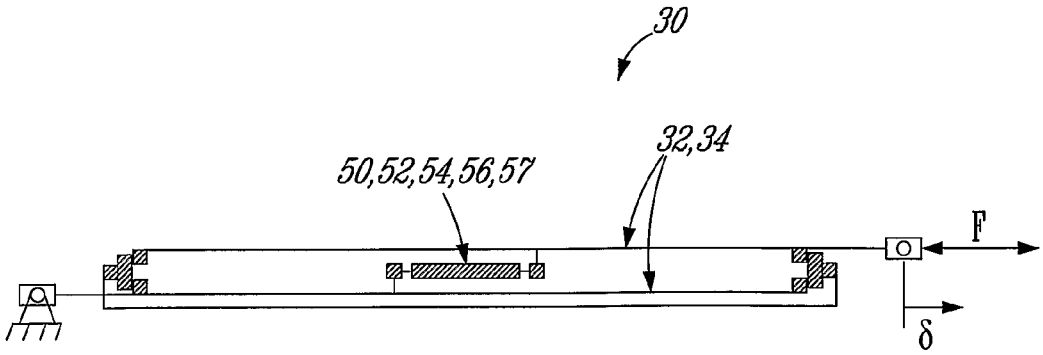
FIG. 5 is a schematic view showing five possible energy dissipative systems which may be used in the brace apparatus of FIG. 1.

The yielding mechanisms 52, which are schematically shown FIG. 5, may further be used as part of the energy dissipative system 38 to provide energy dissipative capacity when the two bracing members 32 and 34 are relatively moving. The yielding mechanism 52 includes metallic elements (not shown) inserted between and mounted to the two movable bracing members 32 and 34. The metallic elements (not shown) are generally selected to yield under axial, shear or flexural deformations, or a combination thereof.

The viscous mechanisms 54 and the visco-elastic mechanisms 56, which are schematically shown in FIG. 5, may also further be used as part of the energy dissipative system 38 to provide energy dissipative capacity when the two bracing members 32 and 34 are relatively moving. The viscous mechanism 54 includes viscous devices (not shown) containing viscous fluids (not shown) inserted between and mounted to the two movable bracing members 32 and 34. The viscous mechanism 54 includes visco-elastic materials (not shown) connected to plates inserted between and mounted to the two movable bracing members 32 and 34.

Combinations of more than one of the above mentioned mechanism 50, 52, 54, 56, 57 may then be used to optimize and diversify the hysteretic characteristics of the apparatus 30. With the addition of the tensionable assembly 36, the apparatus 30 is therefore able to exhibit a "Flag-Shaped Hysteresis" behavior, which combines energy dissipative and self-centering capabilities.

Figure 6:
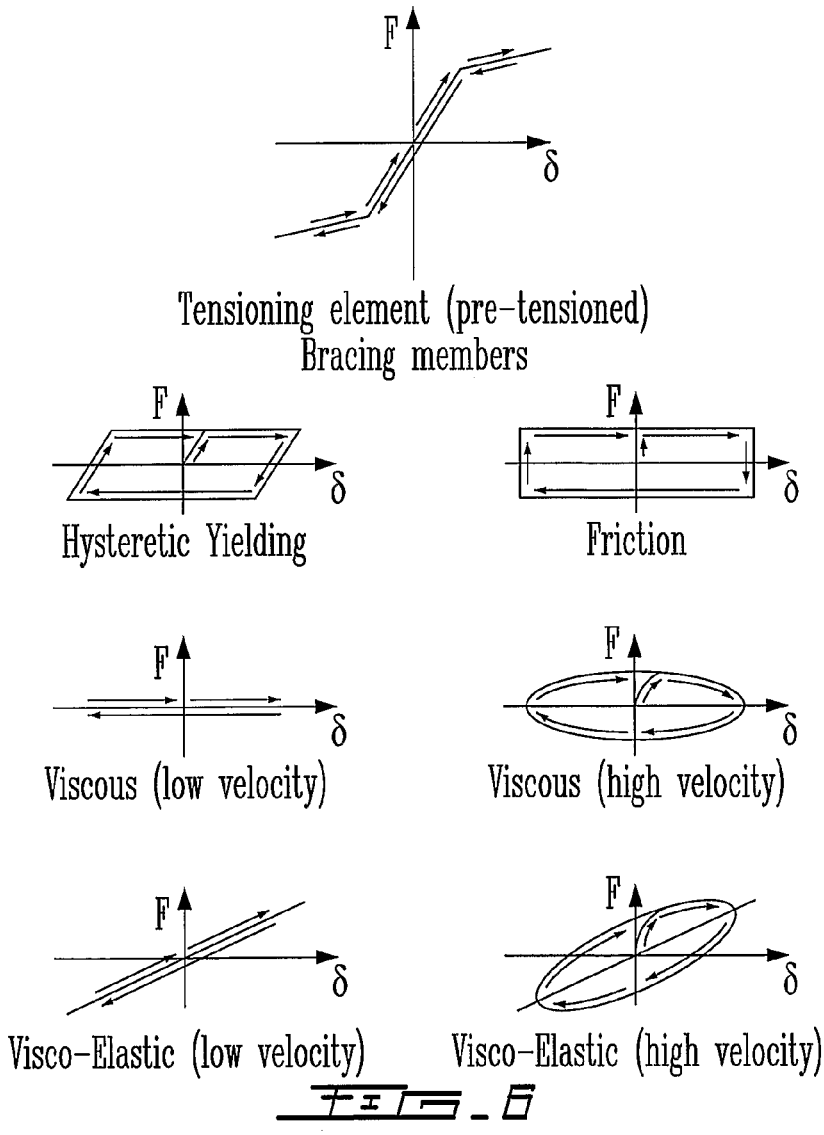
FIG. 6 is a schematic view showing individual hysteretic responses of dissipative mechanisms which may be used in the brace apparatus of FIG. 1.
Figure 7:
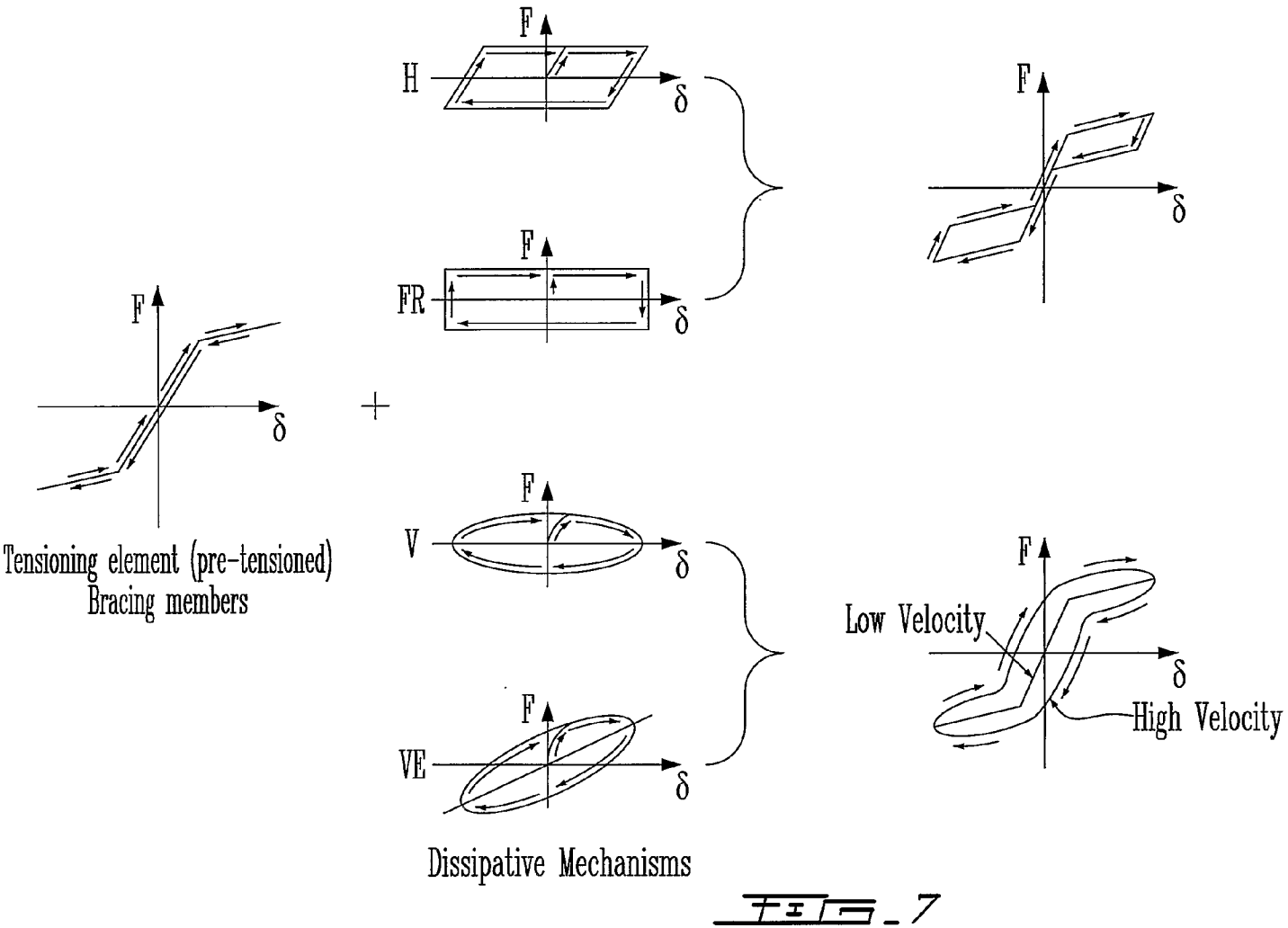
FIG. 7 is a schematic view showing combined hysteretic responses of dissipative mechanisms which may be used in the brace apparatus of FIG. 1.

FIG. 6 shows the individual contributions of the friction, yielding, viscous (at high and low velocity) and visco-elastic (at high and low velocity) mechanisms in terms of their force/deformation behavior. FIG. 7 illustrates some combinations of those mechanisms.

Even if only two different dissipative elements are shown in FIG. 7, a combination of more than two dissipative systems of the same type, or combinations of more than two types of dissipative mechanisms may also be used. Other combinations may also exist, such as for example, three different dissipative systems or more than one energy dissipative mechanism of the same type used in combination with another different energy dissipative mechanism. The overall hysteretic response of the apparatus 30 is generally obtained by summing the contributions from the various components described herein.

Figure 8:
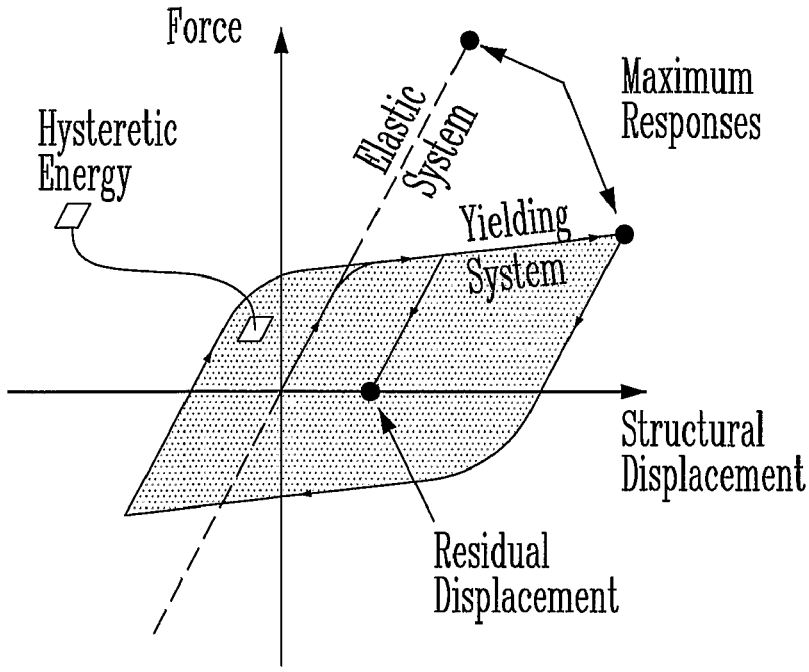
FIG. 8 is a diagram view showing a typical hysteretic response for a yielding system.
Figure 9:
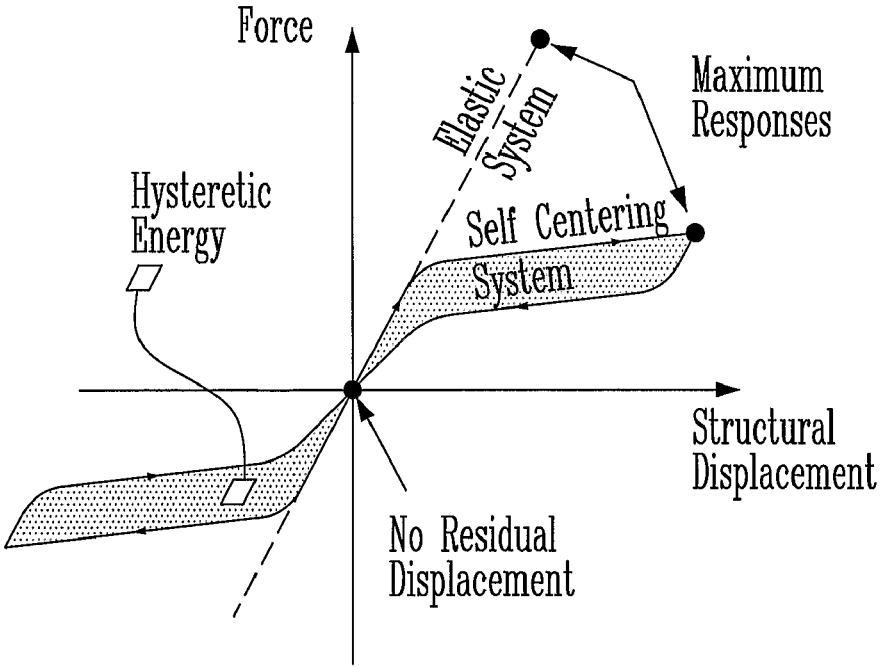
FIG. 9 is a diagram view showing a typical hysteretic response for a self-centering system.
Figure 12A:
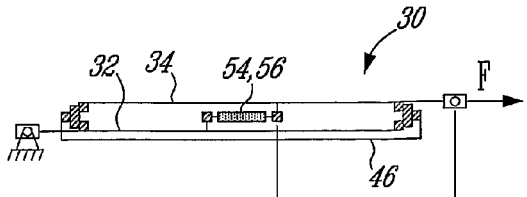
FIG. 12*a* is a schematic view showing the deformation of the different components of the brace apparatus of FIG. 1 equipped with a viscous or visco-elastic energy dissipative mechanism when under tension and before the applied load is large enough to overcome the initial pre-tensioning of the tensioning elements.
Figure 12B:
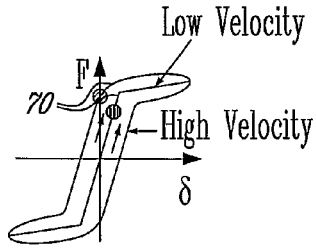
FIG. 12*b* is a diagram of the hysteretic response of the system as shown in FIG. 12*a;*
Figure 12C:
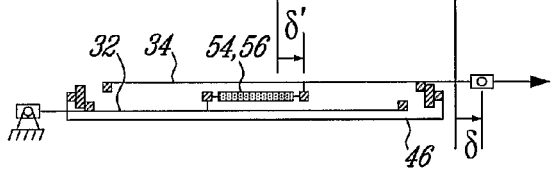
FIG. 12*c* is a schematic view showing the deformation of the different components of the brace apparatus of FIG. 1 equipped with a viscous or visco-elastic energy dissipative mechanism when under tension and when the applied load is large enough to overcome the initial pre-tensioning of the tensioning elements.
Figure 12D:
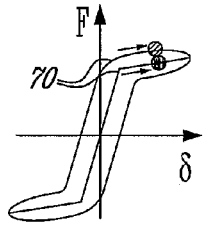
FIG. 12*d* is a diagram of the hysteretic response of the system as shown in FIG. 12*c;*
Figure 13A:
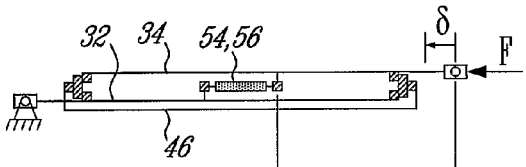
FIG. 13*a* is a schematic view showing the deformation of the different components of the brace apparatus of FIG. 1 equipped with a viscous or visco-elastic energy dissipative mechanism when under compression and before the applied load is large enough to overcome the initial pre-tensioning of the tensioning elements.
Figure 13B:
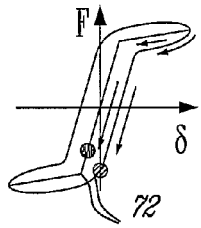
FIG. 13*b* is a diagram of the hysteretic response of the system as shown in FIG. 13*a;*
Figure 13C:
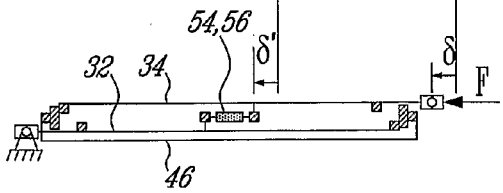
FIG. 13*c* is a schematic view showing the deformation of the different components of the brace apparatus of FIG. 1 equipped with a viscous or visco-elastic energy dissipative mechanism when under compression and when the applied load is large enough to overcome the initial pre-tensioning of the tensioning elements.
Figure 13D:
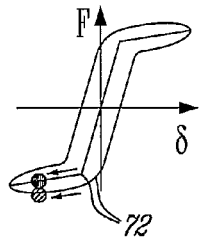
FIG. 13*d* is a diagram of the hysteretic response of the system as shown in FIG. 13*c;*
Figure 15:
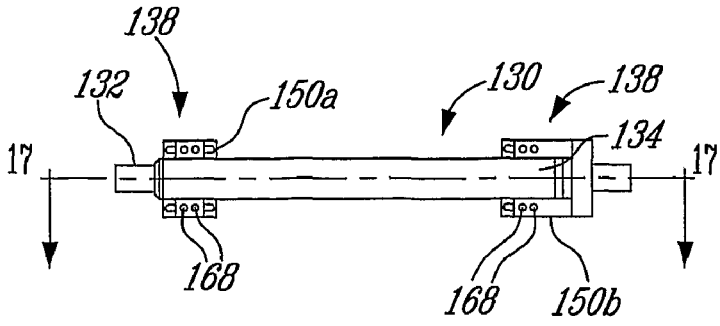
FIG. 15 is a side elevation view of a brace apparatus according to a second illustrative embodiment of the present invention.
Figure 16:
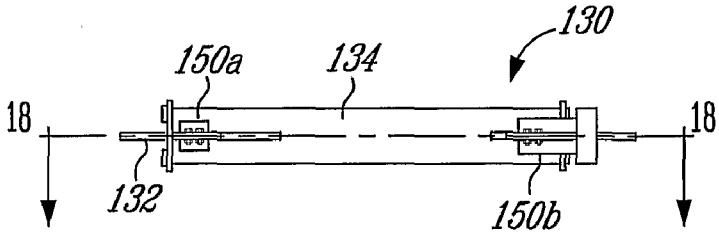
FIG. 16 is a top view of the brace apparatus of FIG. 15.
Figure 17:
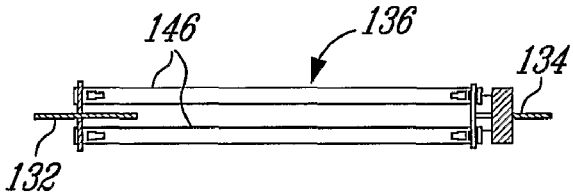
FIG. 17 is a section view taken along line 17-17 in FIG. 15.
Figure 18:
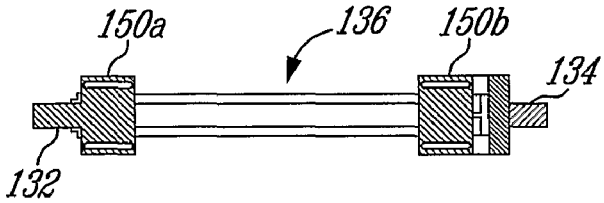
FIG. 18 is a section view taken along line 18-18 in FIG. 16.
Figure 19:
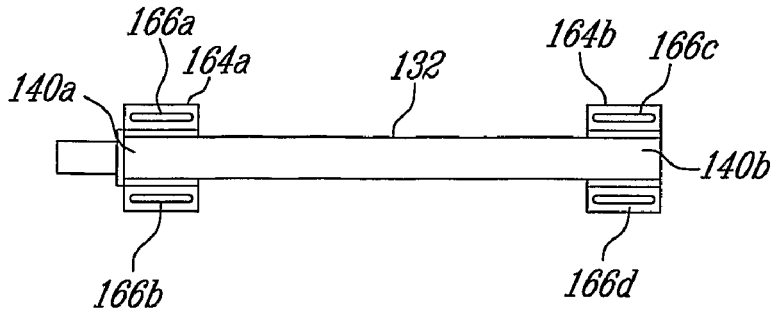
FIG. 19 is a side elevation view showing a first bracing member of the brace apparatus of FIG. 15.
Figure 20:
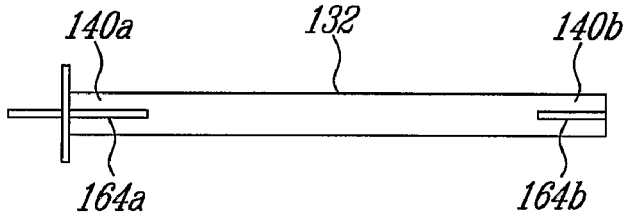
FIG. 20 is a top view of the first bracing member of FIG. 19.
Figure 21:
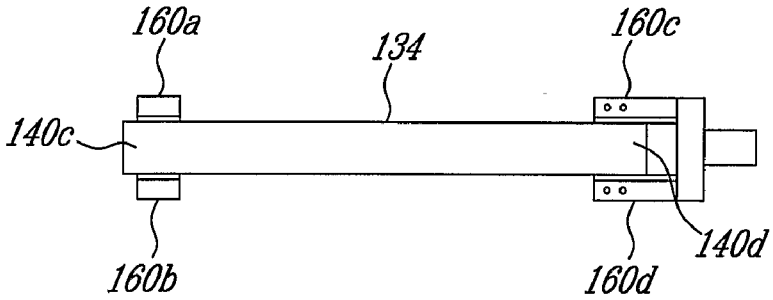
FIG. 21 is a side elevation view showing a second bracing member of the brace apparatus of FIG. 15.
Figure 22:
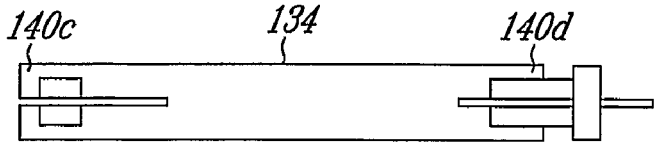
FIG. 22 is a top view of the second bracing member of FIG. 21.

FIG. 8 shows a force displacement curve of a typical linear elastic system and FIG. 9 illustrates a typical self-centering system, both systems representing a yielding structure of equal initial stiffness and mass. In these Figures, the shaded area represents the energy dissipated per cycle through hysteretic yielding, which is generally associated with structural damage to a structure under loading and which can significantly impair a structure and increase its repair costs. The self-centering capacity incorporated in the apparatus 30 offers a hysteretic behavior which is optimized (diagrammatically shown in FIG. 9) having regards to the response and the residual deformation.

Figure 4C:
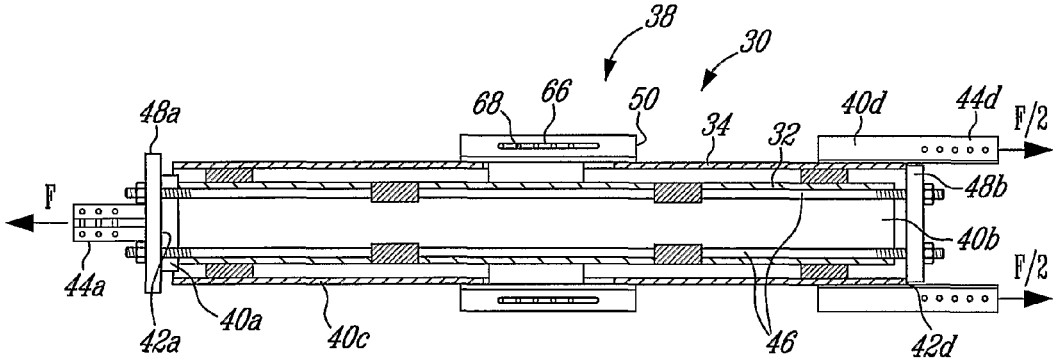
FIG. 4*c* is a side elevation view showing the brace apparatus of FIG. 4*a* subjected to a tension load.
Figure 4D:
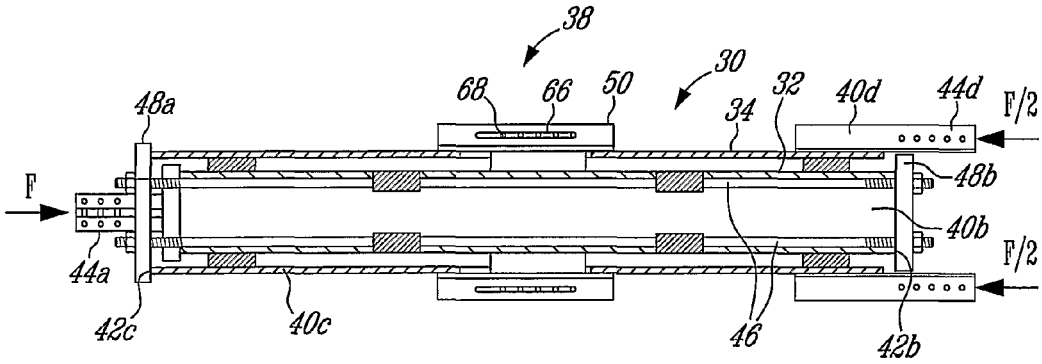
FIG. 4*d* is a side elevation view showing the brace apparatus of FIG. 4*a* subjected to a compression load.

The apparatus 30 in operation is shown in FIGS. 4*c* and 4*d* and schematically illustrated in FIGS. 10*a* to 13*d*. These Figures illustrate the behavior of the brace apparatus 30, at the moment where input energy applied to the structure where the apparatus 30 is mounted to, is transmitted to the apparatus as loading forces, such as for example compression or tension forces. As stated hereinabove, the brace apparatus 30 is mountable to such structures via end connections 44*a*, 44*d* of the first opposed end pair 40*a*, 40*d*. The apparatus 30 is therefore able to receive the loading force such that its configuration changes from a rest position (FIG. 1) to a transitional position where input energy is dissipated by relative motion between the two structural bracing members 32 and 34 (FIGS. 4*c*, 4*d*).

As shown in FIG. 4*c* when under a certain level of tension loading force, the brace apparatus 30 allows for a relative movement of the bracing members 32 and 34. First the pretensioning of the tension elements 46 has to be overcome, which then results in the elongation of the tensioning elements 46 and the initiation of relative movement between the bracing members 32 and 34. In the process, the tensioning elements 46 are further tensioned since abutting surface 42*a* pushes on abutting element 48*a* and since abutting surface 42*d* pushes on abutting element 48*b*. When under a compression force, as illustrated in FIG. 4*d*, the tensioning elements 46 of the tensionable assembly 36 are also further tensioned in the process, since abutting surface 42*c* pushes on abutting element 48*a* and since abutting surface 42*b* pushes on abutting element 48*b*.

By elongating, an additional tension force gradually builds-in the tensioning elements 46 such as to provide the self-centering properties of the brace apparatus 30. For instance, if the loading force was to cease at that time, the apparatus 30 is generally brought back to its rest position (see FIG. 1) by the additional tension force developed in the tensioning element 46. As stated previously, if the level of pre-tension is not sufficient to overcome the force required to activate the energy dissipation mechanisms 38, the apparatus generally does not display a full re-centering capacity, but the tensioning elements 46 generally provide additional post-elastic stiffness to the apparatus 30.

As soon as relative motion between the bracing members 32 and 34 starts to occur under the loading force, the energy dissipative system 38 (only friction mechanism 50 shown in FIGS. 4*c*, 4*d*) are activated, opposing to the relative motion of the bracing members 32 and 34. For instance, when tension is applied to the apparatus 30 as in FIG. 4*c*, and once the initial force and resistance of the tensioning elements 46 are overcome, the apparatus 30 elongates while energy is dissipated through the dissipative system 38. As discussed previously, the illustrative embodiment of FIG. 4*c* shows that the fasteners 68 in a sliding arrangement with the slot 66 generally move along the relative direction of movement of the bracing members 32 and 34.

At that time, depending on the selected tensioning elements 46 with respect to the resistance and configuration of the selected combination of energy dissipative systems 38, the additional tension force developed in the further extended tensioning elements 46 generally provides to the apparatus 30 the capacity of heading back to its initial position (FIG. 1) when the loading force ceases or changes from tension to compression.

Another example highlighting the hysteretic behavior of the apparatus 30 while in operation is schematically illustrated in FIGS. 10*a* to 13*d*. More specifically, FIGS. 10*a* to 11*d* illustrate the hysteretic behavior of a brace apparatus 30 submitted to tension and compression and equipped with a friction mechanism 50 or with a yielding mechanism 52. In FIGS. 12*a* to 13*d* illustrate the hysteretic behavior of the apparatus 30 submitted to tension and compression and equipped with velocity dependant viscous mechanism 54 or visco-elastic mechanism 56.

In all these figures, the elongation of the apparatus 30 under the loading force F is expressed as δ, while δ' illustrates the deformation in the mechanisms 50, 52, 54, 56 mounted to the two bracing members 32 and 34. In FIGS. 12*a* to 13*d*, both a low velocity and high velocity response are illustrated since this energy dissipative system displays a velocity dependent hysteresis. The high velocity response is generally expected during the extreme loading, while the low velocity response (which generally provides the self-centering property) characterizes the expected response following the extreme loading.

For concision purposes, the relative movements involved during operation of the brace apparatus 30 subjected to loading forces will be further explained with reference to FIGS. 10*a* to 11*d* only, but the same principles apply to other combinations of different energy dissipative system (FIGS. 12*a* to 13*d*) as described hereinabove.

FIG. 10*a* schematically illustrates the brace apparatus 30 equipped with a friction mechanism 50 or yielding mechanism 52 mounted to the bracing members 32 and 34 and subjected to a tension loading force, but before the applied tension loading force is large enough to overcome the initial pre-tensioning of the tensioning element 46.

Up to a certain level, a force F tensions the apparatus 30 such that the tensioning element 46 and the dissipative mechanism 50, 52 opposes to the relative motion of the bracing members 32 and 34. At that stage, the apparatus 30 generally starts to linearly deform as schematically illustrated in FIG. 10*b*.

If the loading Force F reaches a certain level which is larger than the force required for overcoming the initial pre-tensioning of the tensioning element 46, the force F reaches the tension separation level (70 in FIGS. 10*b* and 10*d*). At that time, the members 32 and 34 start moving in opposite directions by a distance δ, as schematically illustrated in FIG. 10*c*. The stiffness then changes from the elastic to the post-elastic stiffness. The tensioning element 46 mounted to both members 32 and 34 is therefore elongated by a generally similar displacement and may deform under such loading. The dissipative mechanism 50, 52 generally also deforms by a displacement δ'.

Once the loading force changes its direction such as it usually does in an oscillatory earthquake loading, the opposite compression force F shown in FIG. 11*a* moves the bracing members 32 and 34 toward their original position, which generally corresponds to an opposite and equal displacement δ. At this stage, the two bracing members 32 and 34 are generally aligned and the dissipative mechanism 50, 52 generally put back to its initial configuration. If no compression force F is provided after the tension loading F, the additional tension force built in the tensioning element 46 generally repositions the bracing members 32 and 34 to the configuration shown in FIG. 11*a*. As explained hereinbefore, this phenomenon may be explained by the pre-tensioned and further stretched condition of the tensioning element 46.

As seen in FIG. 11*b*, the corresponding hysteretic response of the dissipative mechanism 50, 52 moves from the tensioned side of the force F toward the compression side of the force F by passing generally near the zero force-displacement point in the diagram. In the case where no opposite compressive force F is provided, the additional tension force of the tensioning element 46 returns the system to the rest position, generally corresponding to the zero force-displacement point in the diagram.

When the opposite force F reaches a compression separation level 72 required for overcoming the initial pre-tensioning of the tensioning element 46, as illustrated in FIG. 11*d*, the dissipative mechanism 50, 52 and the tensioning element 46 are overcome such that the bracing members 32 and 34 start moving in opposite directions by a distance δ. The dissipative mechanisms 50, 52 then generally deform by a corresponding displacement δ'.

Generally speaking, the relative movements of the various components of the apparatus 30 described hereinabove may alternate as long as the deformation imposed on the apparatus 30 remains within the maximum deformation for which the apparatus 30 has been sized for. As described hereinbelow in other illustrative embodiments, the bracing members 32 and 34 may include specially designed end connections 44*a* and 44*d*, or an additional structural element generally mounted in series to the apparatus 30, that may be designed to yield or slip with friction prior to attaining the ultimate deformation capacity of the tensioning elements 46, and thus minimizes the possibilities of the tensioning elements 46 failing in the event of unexpectedly higher deformations caused by energy input level higher than anticipated and thus protect the integrity of the apparatus 30.

The bracing members 32 and 34 are typically made out of any material generally used for rigid structures or architectural constructions, such as, for example, steel, aluminum or fiber reinforced polymers (FRP). The material of the members 32 and 34 is generally chosen to prevent or minimize the buckling or yielding occurrences and, thereby, to significantly reduce damages to the portions of the structure to where the members 32 and 34 are mounted. The tensioning elements 46 may also further be made from various types of materials such as for example tendons bars or cables which may be made of, but not limited to, high strength steel tendons, rods, bars or of composite FRP tendons or bars including, for example Aramid, Carbon, Glass or the like. The tensioning elements 46 may further be provided with a UV or fire protective layer.

The apparatus 30 which as been described herein may therefore be used by being mounted on, connected to or integrated in various types of structures 74, such as for example in, multi-storey structures, buildings, towers, bridges, offshore platforms, storage tanks, etc., some being shown in FIGS. 14*a* to 14*j*.

The apparatus 30 may further be used for new constructions which are built with traditional lateral load resisting systems (conventional braced frames, moment-resisting frames, shear walls, etc.) or with added dampers that do not exhibit the self-centering property. Structures may further be built with the apparatus 30 to enhance their seismic performance level, such structures including, for example, machine parts, buildings, bridges, towers, offshore marine structures, bridges or other structural applications (towers, chimneys. These structures may be subject to any type of loading, including acoustical, seismic, blast, impact wave and wind loading.

The apparatus 30 may still further be used with existing constructions which need to be strengthened or rehabilitated to meet more recent (generally more stringent) seismic code provisions or higher performance criteria. Rehabilitation of these structures could be done by using the proposed apparatus 30 for enhanced response under severe or extreme seismic or wind loading conditions. The apparatus 30 may also further be used in important structures which need to be protected from extreme blast loads. Furthermore, the apparatus 30 may also be used in other applications, such as for example, in mechanical engineering for vehicles subjected to impact, equipment or machinery that can be subjected to overloading or unanticipated loading conditions, etc.

The apparatus 30 is generally installed as a brace element between framing members in a structure, at an angle, vertically or horizontally at the base of structures, or generally in parallel with any movement within the structure that may necessitate control.

The fabrication of the apparatus 30, its inter-connections and its connections to existing structures generally involve steps which may be made by regular construction workers. The apparatus 30 is generally entirely self-contained. Once assembled in the production factory, the apparatus 30 is then generally readily attachable or mountable to the structures in a similar way as traditional bracing elements are generally attached, by bolting or welding of the end connections (44*a*, 44*d* in FIG. 4*a*) to the main structure needing bracing.

The apparatus generally includes inspection provisions, such as for example in the form of holes (not shown) in the bracing members to provide for inspection of the energy dissipative mechanisms that undergo deformations and dissipate input energy under extreme or repetitive loading conditions. If needed, the energy dissipative mechanisms may be individually replaceable from the inspection provisions following an extreme loading event.

A person skilled in the art will also easily understand that the number and the physical properties of tensioning elements may vary, and that the size, the shape, and numbers of bracing members may also vary. For instance, the bracing members may be made of circular, square or rectangular steel tubes or any combinations thereof. Other shapes can be used such as interconnected plates, I-shapes, C-shapes, etc. Further, other configurations and other types of energy dissipation systems may be used. More specifically, the friction mechanisms described may be located in a single location or in two or more locations, at any position along the length of the brace apparatus.

A brace apparatus 130 according to a second embodiment of the invention is illustrated in FIGS. 15 to 22. For concision purposes, only the differences between the brace apparatus 130 and the brace apparatus 30 illustrated in FIGS. 1 to 14*j* will be described hereinbelow. For simplification purposes, end connections (44*a*, 44*d*) will not be represented on FIGS. 15 to 22.

In this second illustrative embodiment, the brace apparatus 130 includes a first bracing member 132, a second bracing member 134, a tensionable assembly 136 and an energy dissipative system 138.

The energy dissipative system 138 includes two friction mechanisms 150*a*, 150*b* provided in proximity of the ends 140*a*, 140*b*, 140*c*, 140*d*. These friction mechanisms 150*a*, 150*b* each includes support members 160*a*, 160*b*, 160*c*, 160*d* mounted on the second bracing member 134 and extending members 164*a*, 164*b* mounted on the first bracing member 132. In this illustrative embodiment, the support members 160*c*, 160*d* and the extending member 164*a* further act as end connections for mounting the apparatus 130 on external structures and transmitting the loading force to the apparatus 130.

The extending members 164*a*, 164*b* each include slots 166*a*, 166*b*, 166*c*, 166*d* where fasteners 168 are received in, such as to clamp the extending members 164*a* 164*b* with the support members 160*a*, 160*b*, 160*c*, 160*d*. The slots 166*a*, 166*b*, 166*c*, 166*d* and fasteners 168 are mounted in a sliding arrangement to allow a restrained relative under friction movement between the bracing members 132, 134.

A person skilled in the art will easily understand that the energy dissipative mechanism illustrated in this embodiment may be replaced by another hereinabove presented energy dissipative mechanism, such as, for example, a yielding, viscous, visco-elastic, or hysteritic mechanism.

Figure 23:
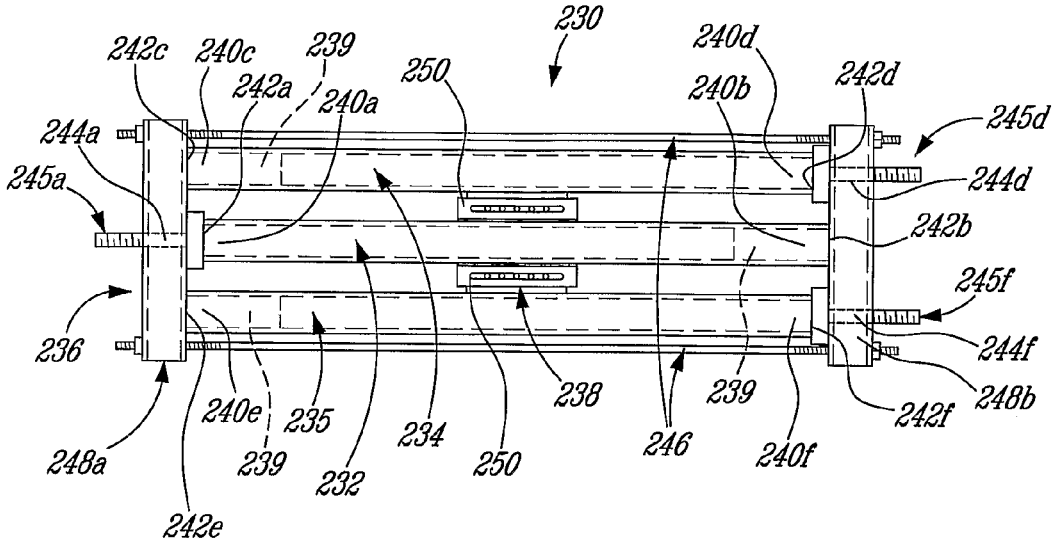
FIG. 23 is a top view of a brace apparatus according to a third illustrative embodiment of the present invention.

A brace apparatus 230 according to a third embodiment of the invention is illustrated in FIG. 23. For concision purposes, only the differences between the brace apparatus 230 and the brace apparatus 30 illustrated in FIGS. 1 to 14*j* will be described hereinbelow.

In this illustrative embodiment, the brace apparatus 230 includes an inner bracing member 232, and two outer bracing members 234, 235 that are located on each side of the inner bracing member 232, a tensionable assembly 236, an energy dissipative system 238 and guiding elements 239.

The inner and outer bracing members 232, 234, 235 have ends 240*a*, 240*b*, 240*c*, 240*d*, 240*e*, 240*f* provided with respective abutting surfaces 242*a*, 242*b*, 242*c*, 242*d*, 242*e*, 242*f*. Ends 240*a*, 240*d* and 240*f* are further provided with end connections 244*a*, 244*d*, 244*f*, which in this embodiment include a threaded portion 245*a*, 245*d*, 245*f*.

The tensionable assembly 236 includes abutting elements 248*a*, 248*b* interconnected by tensioning elements 246. The abutting elements 248*a*, 248*b* are in proximity of the ends 240*a*, 240*b*, 240*c*, 240*d*, 240*e*, 240*f* and the tensioning elements 246 are symmetrically positioned with respect to the inner and outer members 232, 234, 235 such as to favor a generally evenly distributed loading force in the tensionable assembly 236 and allow a generally uniform deformation of the apparatus 230 in operation. In this illustrative embodiment, the tensioning elements 246 are positioned outward of the outer members 234, 235.

The energy dissipative system 238 includes two friction mechanisms 250 that are each fixedly mounted to the inner bracing member 232, and which extend in a frictional connection with the outer bracing members 234, 235.

The guiding elements 239 are fixedly mounted to the each of the tensioning members 248*a*, 248*b* and mounted in a guiding cooperation with the ends 240*b*, 240*c*, 240*e* of the bracing members 232, 234, 235 which are not provided with an end connection 244*a*, 244*d*, 244*f*. The guiding elements 239 generally slidably restrain and guide the relative movement of the bracing members 232, 234, 235. Optionally, the guiding elements 239 are mountable outside of the bracing members 232, 234 and 235.

The brace apparatus 230 operates in a similar way as described in the first embodiment. However, the loading force applied to the outer bracing members 234, 235 is half the force applied to the inner bracing member 232, but the effective apparatus 230 elongation is the same since two outer bracing members 234, 235 participate in elongating the apparatus 230.

A person skilled in the art will easily understand that the energy dissipative mechanism illustrated and described in this embodiment may be replaced by another hereinabove presented energy dissipative mechanism, such as, for example, a yielding, viscous, visco-elastic, or hysteritic mechanism.

Figure 24:
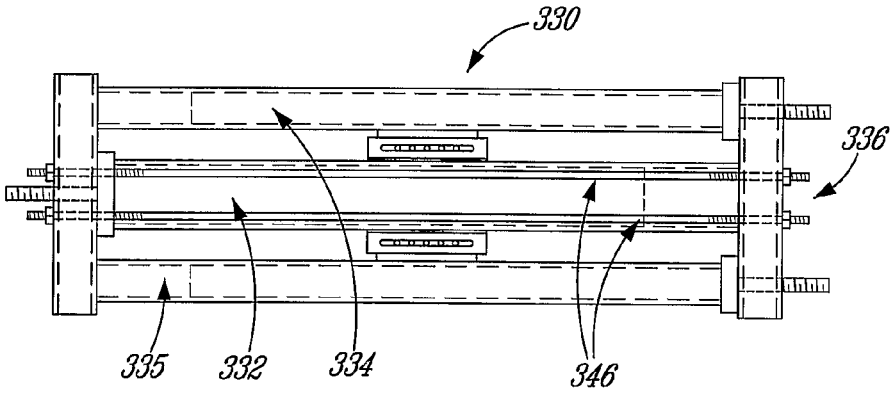
FIG. 24 is a top view of brace apparatus according to a fourth illustrative embodiment of the present invention.

A brace apparatus 330 according to a fourth embodiment of the invention is illustrated in FIG. 24. For concision purposes, only the differences between the brace apparatus 330 and the brace apparatus 230 illustrated in FIG. 23 will be described hereinbelow.

In this illustrative embodiment, the tensioning elements 346 of the tensionable assembly 336 are located inside the inner bracing member 332 and inward with respect to the outer bracing members 334, 335. Optionally, the tensioning elements 346 may be located inside the outer bracing members 334, 335.

A person skilled in the art will easily understand that the energy dissipative mechanism illustrated in this embodiment may be replaced by another hereinabove presented energy dissipative mechanism, such as, for example, a yielding, viscous, visco-elastic, or hysteritic mechanism.

Figure 25:
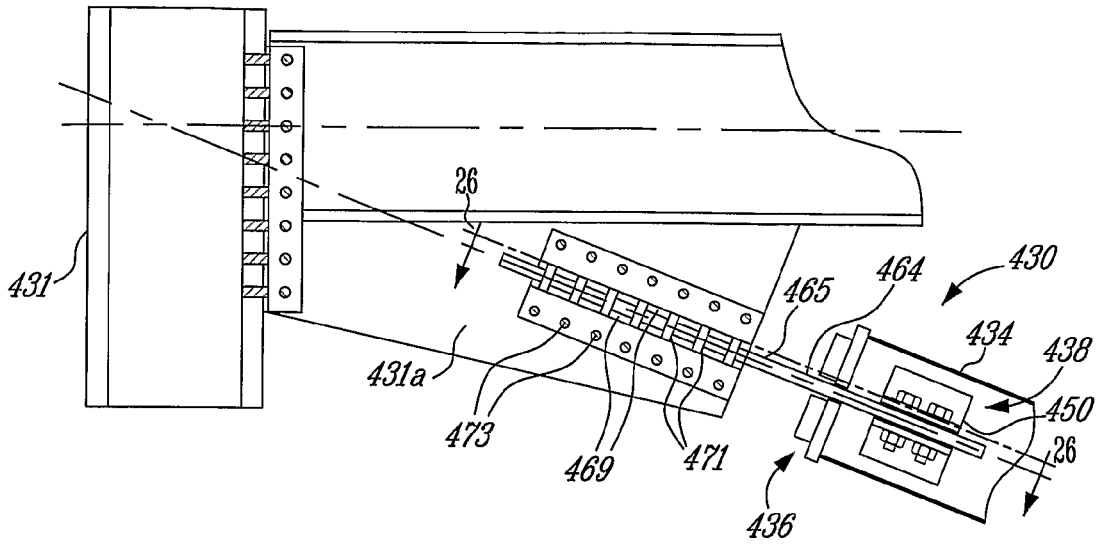
FIG. 25 is a top view of brace apparatus according to a fifth illustrative embodiment of the present invention.
Figure 26:
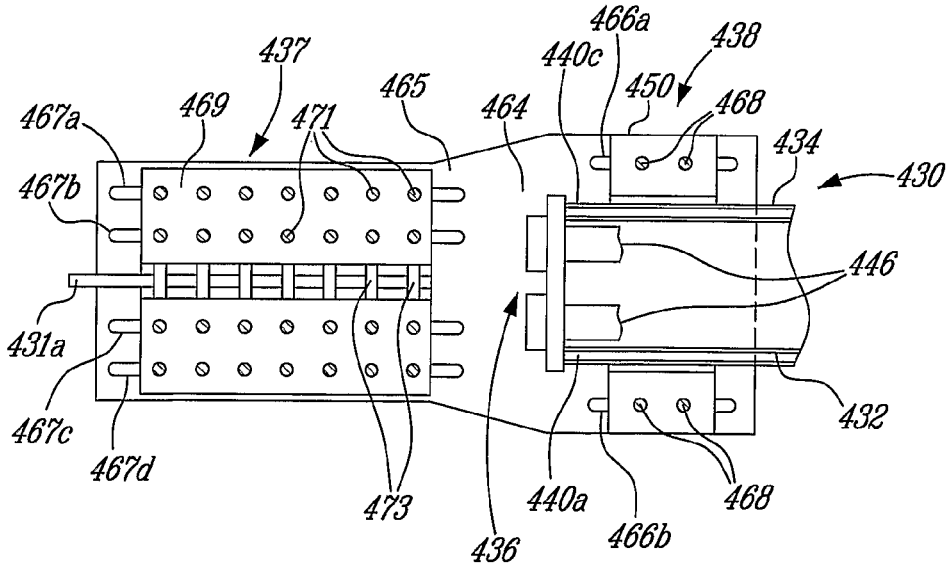
FIG. 26 is a cross-sectional view taken along line 26-26 in FIG. 25.

A brace apparatus 430 according to a fifth embodiment of the invention is illustrated in FIGS. 25 and 26. For concision purposes, only the differences between the brace apparatus 430 and both the brace apparatus 30 illustrated in FIGS. 1 to 14*j* and the brace apparatus 130 illustrated in FIGS. 15 to 22 will be described hereinbelow.

The brace apparatus 430 is mounted to an external structure 431 at an attachment portion 431*a*. The brace apparatus 430 includes a first bracing member 432, a second bracing member 434, a tensionable assembly 436, a fuse system 437 and an energy dissipative system 438.

The energy dissipation system 438 includes a friction mechanism 450 which includes an extending member 464 with an end portion 465 protruding from the apparatus 430 such as to be mountable to the attachment portion 431*a* and thereby receive and transmit the loading force to the apparatus 430. In the illustrative embodiment, the end portion 465 includes four slots 467*a*, 467*b*, 467*c*, 467*d* configured and sized as to cooperate with the fuse system 437.

The fuse system 437 includes a slipping member 469 provided with a plurality of fasteners 471. The slipping member 469 includes connectors 473 so configured and sized as to cooperate with the attachment portion 431*a*.

The fasteners 471 are mounted in a sliding arrangement with the slots 467*a*, 467*b*, 467*c*, 467*d* to allow a restrained relative and under friction movement, which generally occurs at a predetermined load, between the apparatus 430 and the attachment portion 431*a*.

For instance, the slip load of the slipping member 469 with respect to the slipping portion 465 is adjustable to occur at a value corresponding to an acceptable maximum deformation value of the apparatus 430, such that once the slip of the slipping member 469 occurs, any additional deformation in the apparatus 430 occurs between the slipping member 469 and the slipping portion 465. At that time, no additional deformation is imposed on the tensioning elements 446.

To further provide that the deformation occurs between the slipping member 469 and the slipping portion 465 while minimizing the probability of overloading and damaging the apparatus 430, the deformation capacity of the energy dissipative system 438 may be limited to a pre-determined value preventing further relative movement to develop between the bracing members 432 and 434.

For instance, for a friction mechanism 450 as illustrated in this embodiment, the length of the slots 466*a*, 466*b* are adjustable such that when the acceptable deformation value is reached in the apparatus 430, the fasteners 468 of the friction mechanism 450 start bearing on the edges of the slots 466*a*, 466*b* thus opposing to any more relative deformation in the apparatus 430 and consequently, in the tensioning elements 446. It is generally at that time that any additional deformation occurs between the slipping member 469 and the slipping portion 465, as described hereinabove.

A person skilled in the art will easily understand that the fuse system 437 described in this embodiment may also be used by replacing the friction mechanism by another energy dissipative mechanism or other blocking systems to protect the apparatus in case of excessive deformation demand such as, for example, a yielding mechanism. Further, the fuse system described in this embodiment may further be used with any of the previously described embodiments and that the number of slots, the type and number of fasteners and connectors may vary according to the design requirements of the brace apparatus.

Although the present invention has been described hereinabove by way of preferred illustrative embodiments thereof, it can be modified, without departing from the spirit and nature of the subject invention as defined in the appended claims.

What is claimed is:

1. A brace apparatus to be mounted between two portions of a structure subjected to a loading force to limit movements due to the loading force, said brace apparatus comprising:

a fixed portion having a first end to be fixedly mounted to one of the two portions of the structure; said first end of said fixed portion defining a first fixed portion abutting surface, said fixed portion having a second end defining a second fixed portion abutting surface, said second end of said fixed portion being a free end positioned on a side opposite said first end of said fixed portion in a direction of movement;

a movable portion having a first end to be fixedly mounted to another one of the two portions of the structure; said first end of said movable portion defining a first movable portion abutting surface, said movable portion having a second end defining a second movable portion abutting surface, said second end of said movable portion being a free end positioned on a side opposite of said first end of said movable portion in the direction of movement;

a tensionable assembly mounting said movable portion to said fixed portion so that a) said first movable portion abutting surface is in proximity of the second fixed portion abutting surface, and b) said first fixed portion abutting surface is in proximity of the second movable portion abutting surface; said tensionable assembly including a first abutting element in the proximity of the first end of the fixed portion and a second abutting element in the proximity of the first end of the movable portion; said first and second abutting elements being interconnected by an adjustable tensioning element located within said movable portion;

wherein:

i) when a loading force moves the movable portion away from the fixed portion, said first abutting element abuts the first fixed portion abutting surface and said second abutting element abuts the first movable portion abutting surface to thereby limit the movement of the movable portion away from the fixed portion, and ii) when a loading force moves the movable portion towards the fixed portion, said first abutting element abuts the second movable portion abutting surface and said second abutting element abuts the second fixed portion abutting surface to thereby limit the movement of the movable portion towards the fixed portion.

2. A brace apparatus as recited in claim 1, wherein said tensioning element is pre-tensioned.

3. A brace apparatus as recited in claim 2, wherein tensioning element is pre-tensioned at a pre-tension level ranging from 60% of a maximum allowed deformation of said tensioning element to a value corresponding to no pre-tension.

4. A brace apparatus as recited in claim 3, wherein said movable portion moves with respect to said fixed portion when the loading force overcomes said pre-tension level.

5. A brace apparatus as recited in claim 4, wherein said tensioning element elongates when the loading force overcomes said pre-tension level such that an additional tension force builds-in said tensioning element as said apparatus is moved from a rest position to a transitional position, said additional tension force being able to restore said apparatus back to said rest position when the loading force ceases.

6. A brace apparatus as recited in claim 2, wherein said tensioning element is a longitudinally extending threaded member attached to said first and said second abutting elements via nuts.

7. A brace apparatus as recited in claim 2, wherein said tensioning element is a tendon fixedly mounted to said first and said second abutting elements.

8. A brace apparatus as recited in claim 2, wherein said tensioning element includes more than one tensioning elements which are symmetrically positioned with respect to said first and second abutting elements.

9. A brace apparatus as recited in claim 1, wherein said fixed portion and said movable portion have tubular bodies and said movable portion is located inside said fixed portion.

10. A brace apparatus as recited in claim 9, wherein said movable portion is concentric with said fixed portion.

11. A brace apparatus as recited in claim 1, wherein said fixed portion includes two fixed portions positioned on each side of said movable portion.

12. A brace apparatus as recited in claim 1, wherein said brace apparatus further includes guiding elements securely mounted to said first abutting element and said second abutting element, said guiding elements being provided in proximity of said second end of said movable portion and said second end of said fixed portion for providing guidance upon relative movement of said movable portion and said fixed portion.

13. A brace apparatus as recited in claim 1, wherein said apparatus further includes an energy dissipation system linking said fixed portion to said movable portion, said energy dissipation system being operable upon a relative movement between said fixed portion and said movable portion for dissipating energy.

14. A brace apparatus as recited in claim 1, wherein said apparatus further includes an end connection protruding from at least one of said first ends and a fuse system including a slipping element mounted to said end connection and mounted to one of the two portions of the structure, said fuse system being so configured and sized as to slip with respect to said end connection at a predetermined slip load which is higher than the loading force.

15. A brace apparatus as recited in claim 14, wherein said slipping element is mounted in a frictional cooperation to said end connection via fasteners engaged within slots in said end connection for providing an under friction slip movement between said brace apparatus and the structure.

16. A brace apparatus as recited in claim 14, wherein said end connection includes an extending member securely mounted on said movable portion and in a frictional cooperation with a support member securely mounted to said fixed portion.

17. A brace apparatus as recited in claim 16, wherein said extending member includes a slot clamping said support to said extending member via fasteners engaging said slot for generating friction upon said relative movement between said fixed portion and said movable portion under the loading force.

18. A brace apparatus as recited in claim 17, wherein said predetermined slip load generates a maximum allowable relative movement between said fixed portion and said movable portion.

19. A brace apparatus as recited in claim 18, wherein said slots have a length defined by opposed edges and wherein said maximum allowable relative movement between said fixed portion and said movable portion corresponds to said fasteners bearing on said opposed edges of said slots.

20. A brace apparatus as recited in claim 1, wherein said first end of said fixed portion is slidably mounted to said first abutting element and said first end of said movable portion is slidably mounted to said second abutting element.

21. A brace apparatus as recited in claim 1, wherein said first end of said fixed portion and said first end of said movable portion include threaded end connections for mounting said brace apparatus to the two portions of the structure.

22. A brace apparatus as recited in claim 1, wherein said apparatus further includes guiding elements provided between said fixed portion and said movable portion for guiding a relative movement between said fixed portion and said movable portion.

23. A brace apparatus as recited in claim 22, wherein said guiding elements include absorbing elements mounted between said fixed portion and said movable portion for mitigating impact when said movable portion is relatively moving with respect to said fixed portion.

24. A brace apparatus to be mounted between two portions of a structure subjected to a loading force to limit movements due to the loading force, said brace apparatus comprising:

a fixed portion having a first end to be fixedly mounted to one of the two portions of the structure; said first end of said fixed portion defining a first fixed portion abutting surface, said fixed portion having a second end defining a second fixed portion abutting surface, said second end of said fixed portion being a free end positioned on a side opposite said first end of said fixed portion in a direction of movement;

a movable portion having a first end to be fixedly mounted to another one of the two portions of the structure; said first end of said movable portion defining a first movable portion abutting surface, said movable portion having a second end defining a second movable portion abutting surface, said second end of said movable portion being a free end positioned on a side opposite of said first end of said movable portion in the direction of movement;

a tensionable assembly mounting said movable portion to said fixed portion so that a) said first movable portion abutting surface is in proximity of the second fixed portion abutting surface, and b) said first fixed portion abutting surface is in proximity of the second movable portion abutting surface; said tensionable assembly including a first abutting element in the proximity of the first end of the fixed portion and a second abutting element in the proximity of the first end of the movable portion; said first and second abutting elements being interconnected by an adjustable tensioning element located within said movable portion;

wherein, i) when a loading force moves the movable portion away from the fixed portion, said first abutting element abuts the first fixed portion abutting surface and said second abutting element abuts the first movable portion abutting surface to thereby limit the movement of the movable portion away from the fixed portion; ii) when a loading force moves the movable portion towards the fixed portion, said first abutting element abuts the second movable portion abutting surface and said second abutting element abuts the second fixed portion abutting surface to thereby limit the movement of the movable portion towards the fixed portion;

an energy dissipation system linking said fixed portion to said movable portion, said energy dissipation system being operable upon a relative movement between said fixed portion and said movable portion for dissipating energy; and said energy dissipation system includes a friction mechanism including a support member securely mounted to said fixed portion, and an extending member securely mounted to said movable portion and extending to said support member such as to be in a frictional contact with said movable portion.

25. A brace apparatus as recited in claim 24, wherein said support member includes a slot and wherein said extending member is mounted in a clamping arrangement with said support member via fasteners engaging said slot for generating said frictional contact upon said relative movement between said fixed portion and said movable portion.

26. A brace apparatus as recited in claim 24, wherein said friction mechanism further includes a friction interface located between said support member and said extending member, said friction interface being so configured and sized as to provide friction upon said relative movement between said fixed portion and said movable portion.

27. A brace apparatus as recited in claim 24, wherein said friction mechanism includes two friction mechanisms including a first friction mechanism being located near said first end of said fixed portion and a second friction mechanism being located near said first end of said movable portion.

28. A brace apparatus as recited in claim 27, wherein said extending members each include a slot configured and sized as to receive a fastener clamping said extending member to said support member, each of said slot and fastener being mounted in a sliding arrangement for providing a restrained movement of said friction element upon movement of said fixed portion and said movable portion.

29. A brace apparatus as recited in claim 24, wherein said energy dissipation system includes a yielding mechanism including metallic elements mounted to said fixed portion and said movable portion, said metallic elements being so configured and sized as to yield under deformations generated from a relative movement between said fixed portion and said movable portion.

30. A brace apparatus as recited in claim 24, wherein said energy dissipation system includes a viscous mechanism including viscous fluids contained within a device mounted to said fixed portion and said movable portion and which deforms upon a relative movement between said fixed portion and said movable portion.

31. A brace apparatus as recited in claim 24, wherein said energy dissipation system includes a visco-elastic mechanism including a visco-elastic material mounted to said fixed portion and said movable portion which deforms upon a relative movement between said fixed portion and said movable portion.

32. A brace apparatus as recited in claim 24, wherein said energy dissipation system includes at least one dissipation mechanism selected from the group consisting of a friction mechanism, a yielding mechanism, a viscous mechanism and a visco-elastic mechanism exhibiting a flag-shaped hysteresis behavior of said brace apparatus when subjected to the loading force.

* * * * *